US007907742B2

(12) United States Patent
Nakajima et al.

(10) Patent No.: US 7,907,742 B2
(45) Date of Patent: Mar. 15, 2011

(54) EXCITER FOR DIRECTLY VIBRATING BOARD AND SPEAKER APPARATUS USED THE SAME

(75) Inventors: Yuichi Nakajima, Kobe (JP); Kiyoshi Ootani, Kobe (JP); Akira Nishikawa, Kobe (JP); Noboru Hidaka, Kobe (JP)

(73) Assignee: Fujitsu Ten Limited, Kobe-Shi, Hyogo (JP)

( * ) Notice: Subject to any disclaimer, the term of this patent is extended or adjusted under 35 U.S.C. 154(b) by 1391 days.

(21) Appl. No.: 10/977,483

(22) Filed: Oct. 29, 2004

(65) Prior Publication Data

US 2005/0129265 A1 Jun. 16, 2005

(30) Foreign Application Priority Data

Oct. 31, 2003 (JP) ..... 2003-372927
Oct. 31, 2003 (JP) ..... 2003-373075

(51) Int. Cl.
*H04R 25/00* (2006.01)

(52) U.S. Cl. ..... 381/152; 381/162; 381/396

(58) Field of Classification Search ..... 381/152, 381/334, 396–397, 404, 420, 431; 310/27; 340/388.1

See application file for complete search history.

(56) References Cited

U.S. PATENT DOCUMENTS 5,357,586 A * 10/1994 Nordschow et al. ..... 381/397
5,903,076 A * 5/1999 Suyama ..... 310/81
6,526,151 B1 * 2/2003 Peng ..... 381/403
7,079,665 B2 7/2006 Shimomura et al.
7,372,968 B2 * 5/2008 Buos et al. ..... 381/152

FOREIGN PATENT DOCUMENTS

| | | |
|---|---|---|
| JP | 57104396 | 6/1982 |
| JP | 59011100 | 1/1984 |
| JP | 05 9099 | 2/1993 |
| JP | 05068295 | 3/1993 |
| JP | 06 45865 | 6/1994 |
| JP | 07 79497 | 3/1995 |
| JP | 08102994 | 4/1996 |
| JP | 2001061194 | 3/2001 |
| JP | 2002010392 | 1/2002 |
| JP | 2002271889 | 9/2002 |
| JP | 2003143690 | 5/2003 |
| JP | A 2003 143690 | 5/2003 |
| JP | 2003 244787 | 8/2003 |
| WO | WO 02 39781 | 5/2002 |

OTHER PUBLICATIONS

Japan Patent Office, "Notification of Reasons for Rejection", Jan. 5, 2010, Published in: JP.

* cited by examiner

*Primary Examiner* — Curtis Kuntz
*Assistant Examiner* — Ryan Robinson
(74) *Attorney, Agent, or Firm* — Fogg & Powers LLC

(57) ABSTRACT

An exciter for directly vibrating a board treated for dustproofing and heat dissipation, provided with a vibrator comprised of an outer yoke, a permanent magnet, and inner yoke, having a coil fixed inserted between the outer yoke and inner yoke, and having a coupler member for coupling the exciter to the surface of the board. The coupler member and vibrator are connected by an elastic member. A closed space is formed in the exciter by providing a sealing member between the outer yoke and coupler member. A through hole is formed in the outer yoke. Due to the vibration of the vibrator at the time of coil excitation, air convection is caused through the through hole between the closed space and the outside space.

13 Claims, 11 Drawing Sheets

EXCITER FOR DIRECTLY VIBRATING BOARD AND SPEAKER APPARATUS USED THE SAME

CROSS-REFERENCE TO RELATED APPLICATION

This application claims the priorities of Japanese Patent Application No. 2003-37227, filed on Oct. 31, 2003, and Japanese Patent Application No. 2003-373075, filed on Oct. 31, 2003.

BACKGROUND OF THE INVENTION

1. Field of the Invention

The present invention relates to an exciter directly attached to a board member for vibrating the board member and a speaker utilizing this exciter. In particular, the present invention relates to an exciter where heat produced due to the vibration is efficiently dissipated and dust is protected against when the exciter is attached to a board member and is driven as a source of vibration of a speaker and to a speaker designed to eliminate any difference in sound quality occurring in the speaker due to restrictions of the attachment surface of a board member when attaching an exciter to a board member.

2. Description of the Related Art

In the past, in stereo systems, PCs, mobile phones, and other electronic apparatuses, speakers have been used to output audio information from various media. In such speakers, vibration boards for emitting sound are attached to exciters supplied with the drive signals for audio output. These vibration boards have horn shapes specially designed for such speakers. For example, the vibration boards have voice coils of exciters affixed to them. Sound is output by these voice coils vibrating by magnetic circuits.

Such speakers are also used to reproduce music or speech in vehicles, for example, the compartments of passenger cars. These speakers are for example built into the doors of the front seats or are placed on the rear trays. Usually a plurality of speakers are arranged attached to at least one of the front seat and rear seat sides.

In addition to arranging speakers for audio reproduction inside the front seat doors or on the rear trays, arrangement of speakers including direct drive exciters at the ceiling panels of the compartments has for example been disclosed in Japanese Utility Model Publication (Kokai) No. 6-45865.

When attaching usual speakers in a compartment, there are restrictions on the positions of attachment of the speakers. Speakers of too large nominal sizes cannot be used. To deal with this, car-mounted speakers using exciters directly attach the exciters to the ceiling panels and use the ceiling panels as vibration boards to form speakers instead of the conventional speakers having large nominal sizes.

In addition to such exciters, various exciters for board direct drive use able to be used for car-mounted speakers built into ceiling panels etc. have been proposed. An exciter able to be used as a car-mounted speaker is disclosed for example in Japanese Unexamined Patent Publication (Kokai) No. 2003-143690.

To operate such a board direct drive exciter as a speaker, a drive signal is supplied to a coil. The supply of this drive signal, however, causes the coil to generate heat. Even with a usual voice coil type speaker, in the same way as the case of an exciter for board direct drive use, there is a space region inside the voice coil. The heat generated by the voice coil may cause heat buildup in the space region. In the case of such a voice coil type speaker, since the amplitude of vibration of the voice coil is large, it is possible to discharge heat built up in the space region by air convection, so the parts, including the voice coil, will not become high in temperature.

However, in the case of an exciter for board direct drive use, since the space region in the bobbin is communicated with the outside space and the amplitude of the vibration is comparatively small due to the structure for driving vibration, depending on the vibration, the air convection occurring in the space region will be weak and the heat built up will not be able to be exhausted completely. Therefore, the problem of the exciter itself becoming high in temperature will arise and measures will become necessary for preventing deformation due to the heat of the coupler member. Measures become necessary such as employment of a heat resistant material for the interior panel. As a result, the problem of the cost swelling arises.

Further, when forming a speaker by directly attaching an exciter of the type disclosed in Japanese Unexamined Utility Model Publication (Kokai) No. 6-45865 etc. to the interior panel of a vehicle, the space region formed at the inside of the bobbin around which the coil is wound is communicated with the outside space. Therefore, there is the problem of dust, dirt, etc. entering the space region from the outside space. Further, dust, dirt, etc. ends up depositing in the clearances formed by the inner yoke, coil bobbin, or outer yoke forming the exciter. These clearances are filled with dust, dirt, etc. As a result, the air convection due to the vibration occurring at the time of coil drive is weakened or inhibited, so the dissipation of heat generated is inhibited or abnormal noise is generated or disconnection occurs due to rubbing of the voice coil.

On the other hand, speaker are used for reproducing music or speech in the compartment of a vehicle such as a passenger car. These speakers are for example embedded in the doors of the front seats or placed on the rear tray. A plurality of speakers are attached to and arranged at least at one of the front seat side and rear seat side in usual practice.

When attaching usual speakers to the inside of a compartment, there are restrictions on the positions of attachment of the speakers. To deal with the fact that a speaker having too large a nominal size cannot be used, in the audio system disclosed in Japanese Unexamined Utility Model Publication (Kokai) No. 6-45865, a large speaker directly attached to the ceiling panel is used instead of a conventional speaker having a large nominal size.

In such an audio system, front speakers are embedded in the doors of the front seat among the front seats including the driver's seat and the rear seats in the compartment of a passenger car, while a rear speaker is placed on the rear tray of the rear seats. The ceiling panel of the passenger car is generally comprised of an exterior panel and a ceiling panel. The ceiling panel is provided near its center with an exciter for board direct drive use, whereby a speaker is formed. This ceiling panel is usually formed by a material such as urethane or polypropylene foam, so the ceiling panel itself can perform the role of a vibration board of the speaker.

The speaker utilizing the exciter for board direct drive use can form a speaker by directly attaching the exciter to any board member having a suitable area. Since the board member serves as a vibration board, no special vibration board is needed. For example, it is possible to form a car-mounted speaker by a magnetic circuit, frame, vibration board, etc., arrange it near the ceiling of a passenger car, and attach it so that the aperture of the speaker is near the ceiling side, so it is possible to reproduce the medium and high sound regions. By arranging the speaker near the ceiling, it is possible to enhance the feeling of closeness of the sound field and thereby possible to form a better sound field in the compartment.

Note that when employing speakers attaching exciters to an interior panel of a passenger car to form a stereo reproduction space in the compartment of the passenger car, two exciters may be directly attached on the interior panel of the ceiling of the compartment a predetermined distance apart to the left and right.

Here, the pair of exciters are thereby attached to a single common interior panel. As a result of using part of the interior panel as a vibration board, if the interval of arrangement of the pair of exciters is too narrow, even if the exciters driven by the stereo signal are attached independently, the stereo feeling is impaired when listening and the effect becomes monaural.

As will be understood from the state by which this vibration energy is transmitted, to form a stereo reproduction space, the pair of exciters have to be attached to the interior panel a predetermined distance apart. Further, the vibration energy is transmitted over a wider range the flatter the surface, so to obtain the desired sound properties, flatness is required. If considering the formation of an optimal stereo space in the compartment, the positions for attaching the pair of exciters are naturally restricted to a certain range in the front-rear direction of the compartment.

However, depending on the vehicle where a pair of exciters are to be directly attached to the interior panel to try to form the stereo reproduction space, even if the same model of vehicle, the interior etc. will sometimes differ depending on the specifications etc. For example, the same model will include cases of no sunroof and of sunroofs.

Therefore, if trying to form the optimal stereo reproduction space in the compartment, since the shape of the compartment of the same model of vehicle will be the same if the same model, the positions of arrangement of the pair of exciters at the interior panel will be restricted without regard as to the existence of any sunroof. Accordingly, even when a sunroof is provided, the pair of exciters will be attached to the same positions as the case of no sunroof.

However, the range of transmission of vibration energy from the pair of exciters is affected by the sunroof of an interior panel. Therefore, when the same exciters are used, a difference will arise in the sound quality in the stereo reproduction space depending on the sunroof etc.

With a situation where while the same model, a sunroof will cause the sound quality to differ, users purchasing vehicles with sunroofs would complain. If exciters for vehicles with sunroof specifications were developed, those complaints could be eliminated, but there would then be the problem that development of exciters to meet with different specifications of interior panels would cause costs to balloon.

Therefore, in view of these problems, the present invention has as its object the provision of an exciter for board direct drive use designed to improve the air compression rate due to vibration of the space region in a device so as to promote air convection and thereby facilitate dissipation of generated heat and provide dustproofing preventing the entry of dust, dirt, etc. inside the device.

Further, the present invention, in view of the above problem, has as its object the provision of a speaker designed to limit the range of transmission of vibration energy of an exciter even for different specifications of board members forming vibration boards and to utilize an exciter for board direct drive use which enables an exciter having common specifications to be attached to such board members.

SUMMARY OF THE INVENTION

To achieve the above object, the present invention provides an exciter supplied at its coil with a drive signal so as to directly cause a board member to vibrate, provided with an outer yoke comprised of a side wall and a bottom, a permanent magnet attached to the bottom, an inner yoke placed on the permanent magnet and provided with a clearance from the side wall, a coil wound around a cylindrically shaped bobbin and inserted into the clearance, a coupler member fastening the bobbin, attached to a board member, and vibrating due to the coil being supplied with a drive signal so as to make the board member vibrate, an elastic member for elastically supporting the outer yoke and the coupler member, a sealing member partitioning a clearance between the outer yoke and the coil from an outside space, and a passage for communicating a closed space formed by the sealing member and the outside space.

Further, the present invention provides an exciter supplied at its coil with a drive signal so as to directly cause a board member to vibrate, provided with an outer yoke comprised of a side wall and a bottom, a permanent magnet attached to the bottom, an inner yoke placed on the permanent magnet and provided with a clearance from the side wall, a coil wound around a cylindrically shaped bobbin and inserted into the clearance, a coupler member fastening the bobbin, attaching to a board member, and vibrating due to the coil being supplied with a drive signal, a bracket member engaging with the coupler member and fastened to the board member vibrating due to vibration of the coupler member, an elastic member elastically supporting the outer yoke and the coupler member, a sealing member partitioning a clearance between the outer yoke and the coil from an outside space, and a passage for communicating a closed space formed by the sealing member and the outside space.

The sealing member is fastened at one end to the outer yoke and is fastened at the other end to an outer circumference of the bobbin or is fastened at one end to the outer yoke or the elastic members and is fastened at the other end to the coupler member.

Alternatively, the sealing member has a flexible body having a ring shape, and the body is formed integrally with one end face to be joined with the outer yoke or the elastic members and another end face to be joined with the coupler member.

The passage is provided at least at one of the side walls and the bottom, is provided at the bobbin, is provided passing through the inner yoke, the permanent magnet, and the outer yoke, or is provided at the sealing member.

Alternatively, the passage is provided at other than the position where the coupler member is attached to the board or is provided at other than the position where the bracket member is attached to the board when such a member is provided.

The passage has an opening at the closed space side larger than an opening at the outside space side.

The coupler member has an engagement part opening to the closed space for engaging with an engagement part of the bracket member, and the engagement part of the bracket member projects into the closed space and is engaged with the engagement part of the coupler member.

In the exciter of the present invention, the coil is supplied with the drive signal, whereby the board member forms a vibration board and a speaker emitting sound is formed.

The exciter of the present invention is attached to an interior panel of a vehicle as the board member.

The speaker of the present invention is provided with an exciter attached to a board member and supplied with a drive signal for making the board member vibrate, and a vibration limiting member arranged to the board member at a position that is left predetermined distances from an attachment position of the exciter.

Alternatively, the speaker of the present invention is provided with a coupler member attached to a board member, an exciter attached to the coupler member and supplied with a drive signal for making the coupler member vibrate, and a vibration limiting member arranged to the board member at a position that is left predetermined distances away from the attachment position of the exciter.

The vibration limiting member is arranged surrounding the exciter. Further, the vibration limiting member is formed by vibration isolation rubber or are formed including permanent magnet materials. The vibration limiting member is formed in bar shapes.

The coupler member is provided with an arm member pressing the vibration limiting member against the board member.

The speaker of the present invention is attached to an interior panel of a vehicle as the board member. An opposite surface to the surface where the vibration limiting member is fastened to the board member is in proximity to an exterior panel of the vehicle.

As explained above, according to the present invention, there is provided an exciter utilizing a board member as a vibration board which is provided with a sealing member forming a closed space between an outer yoke and a coupler member forming the exciter and which forms between the closed space and the outside space a passage in which air convection occurs corresponding to vibration of the exciter, so the sealing member serves as a dustproofing means preventing the entry of dust, dirt, etc. inside the device and the provision of the passage with the outside space at the closed space formed by the sealing member improves the air compression rate by vibration of the closed space formed, enables air convection to be efficiently generated and forced air cooling to be realized, and prevents the device from becoming high in temperature. Therefore, it is possible to lower the cost of an exciter for board direct drive use.

Further, in the present invention, to form a closed space in the exciter, the sealing member is joined between the entire circumference of an end of the side wall of the outer yoke and the outer circumference of the coupler member, the sealing member has a flexible body having a ring shape, and the body is integrally formed with one end to be joined with the entire circumference of the end of the side wall and another end to be joined with the outer circumference of the coupler member, so at the time of assembly of the exciter, it becomes possible to successively assemble the parts forming the exciter, the work efficiency can be improved, and the airtightness of the closed space formed is also improved.

Further, as explained above, according to the present invention, there is provided a speaker directly attaching an exciter to a board member and emitting sound using that board member as a vibration board, wherein a vibration limiting member for limiting the spread of vibration energy from the exciter is arranged so as to surround the exciter, so even when attaching exciters to board members of different specifications, there is no need for exciters having vibration properties corresponding to the different specification boards, that is, exciters with the same vibration properties can be attached, and even if different specification boards are used, the sound quality of the speakers can be made equal and the sound quality can be prevented from becoming different.

BRIEF DESCRIPTION OF THE DRAWINGS

Other features, objects, and advantages of the present invention will become apparent from the following description of preferred embodiments given with reference to the drawings in which the same reference numerals designate the same or corresponding parts throughout several views, in which.

DESCRIPTION OF THE PREFERRED EMBODIMENTS

To confirm the effects given rise to by the present invention, first, the configuration of an exciter for directly causing a board member to vibrate according to the prior art on which the present invention is based will be explained in detail below.

Figure 15:
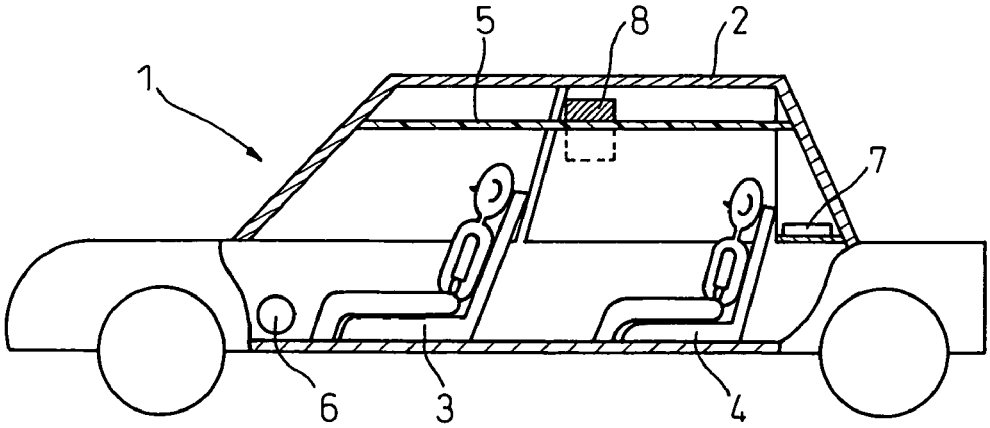
Fig.15 PRIOR ART
FIG. 15 is a view for explaining a state of attachment of a speaker utilizing an exciter according to the prior art to a ceiling interior panel of a vehicle.

FIG. 15 shows the state where car-mounted speakers are installed into a passenger car by a partial longitudinal sectional view of a passenger car. The passenger compartment of a passenger car 1 is provided with front seats 3 including a driver's seat and rear seats 4. The doors at the front seats 3 have front speakers embedded in them. A rear tray of the rear seats 4 carries a rear speaker 7. The ceiling of the passenger car 1 is comprised of an exterior panel 2 and a ceiling panel 5. Near the center of the ceiling panel 5, a later explained exciter 8 is attached, whereby another speaker is formed. This exciter 8 may also be attached between the exterior panel 2 and the ceiling panel 5. As shown by the broken line in FIG. 15, similar effects are obtained even if the exciter 8 is attached to the ceiling panel 5 at the side facing the inside of the passenger compartment.

Figure 16:
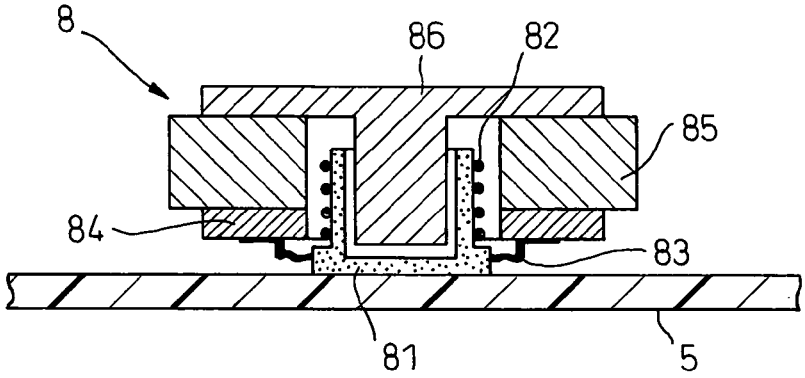
Fig.16 PRIOR ART
FIG. 16 is a view of a cross-section of an exciter for board direct drive use of the prior art.

FIG. 16 shows an example of the speaker comprised by directly attaching the exciter 8 to the ceiling panel 5 by an enlarged cross-sectional view. In the exciter 8, a plate 84 forming a yoke and a pole piece 86 forming another yoke sandwich a ring-shaped magnet 85 between them, whereby an outer magnet type magnetic circuit is formed. A voice coil 82 is provided in a clearance between the pole piece 86 and the plate 84 forming this magnetic circuit. The voice coil 82 is wound around a bobbin 81. A seat of the bobbin 81 is fastened to the ceiling panel 5. Further, a damper 83 attached to the plate 84 is fastened to the seat of the bobbin 81.

The ceiling panel 5 itself functions as a vibration board. If the voice coil 82 is given an AC signal, the ceiling panel 5 connected to the bobbin 81 around which the voice coil 82 is wound can be made to vibrate so as to produce a sound corresponding to the AC signal. By using the ceiling panel 5 as a vibration plate in this way, a large vibration plate area can be secured, so good sound reproduction in the medium and high sound regions becomes possible.

On the other hand, a specific example of the configuration of an improved exciter having a configuration different from the exciter shown in FIG. 16 will be explained with reference to FIG. 17 and FIG. 18.

Figure 17:
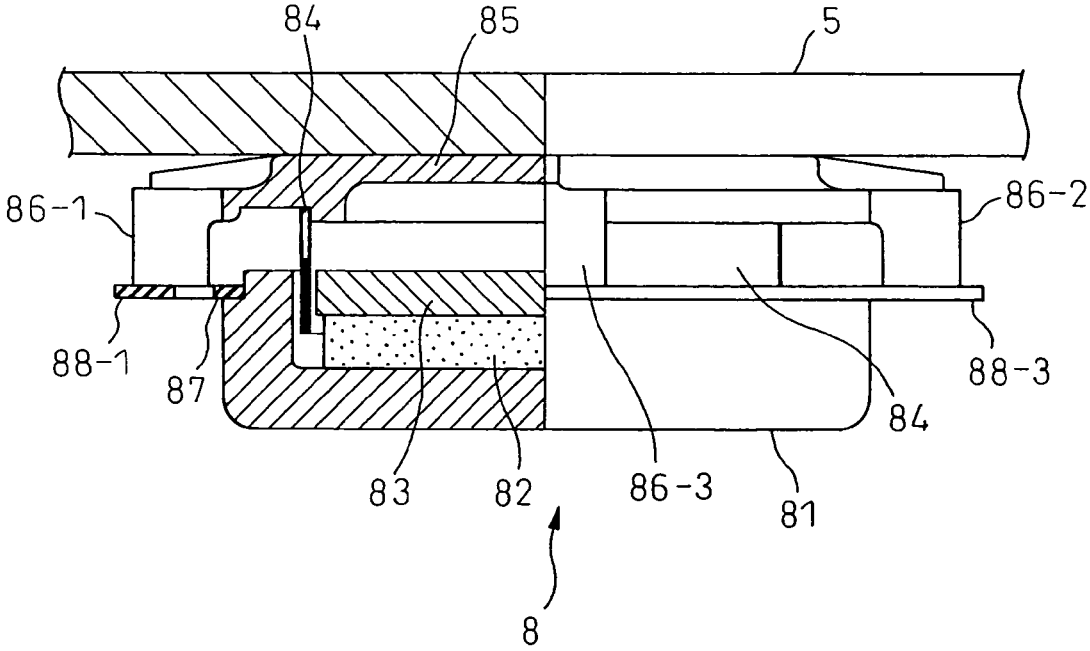
Fig.17 PRIOR ART
FIG. 17 is a view for explaining another example of the configuration of an exciter for board direct drive use.

In FIG. 17, the exciter 8 is for example shown in the state directly attached to an interior panel 5 of a vehicle. The left half from the center is shown by a lateral cross-sectional view. The exciter 8 is provided with a dish-shaped outer yoke 81 having a recessed part formed by side walls and a bottom connected with each other, a disk-shaped permanent magnet 82 attached to the bottom, and a disk-shaped inner yoke carried on the permanent magnet 82 and somewhat larger than the permanent magnet 82. A clearance is provided between the inner circumference of the side walls of the outer yoke 81 and the outer circumference of the inner yoke 83. Due to this, a magnetic circuit is formed.

This exciter 8 is provided with a coupler member 85 for attachment to an interior panel 5. The coupler member 85 is provided with a plurality of elastic member supports 86-1 to 86-3 formed integrally with the coupler member 85 for vibratably supporting the magnetic circuit configuration comprised of the outer yoke 81, permanent magnet 82, and inner yoke 83 with respect to the coupler member 85.

Figure 18:
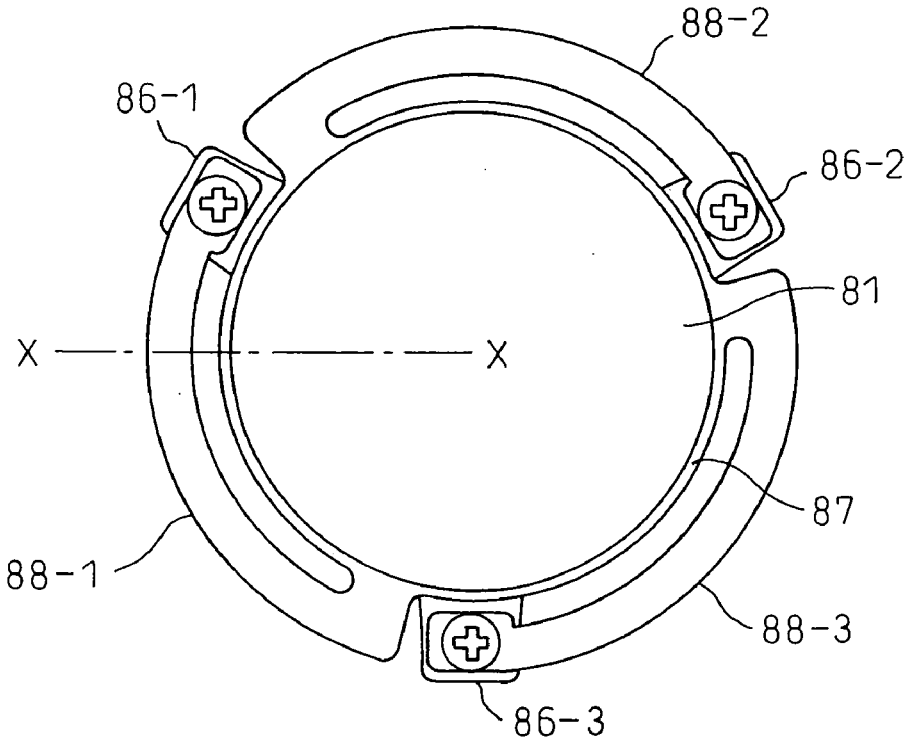
FIG. 18 is a view for explaining the state of the exciter shown in FIG. 17 viewed from below.
Figure 19A:
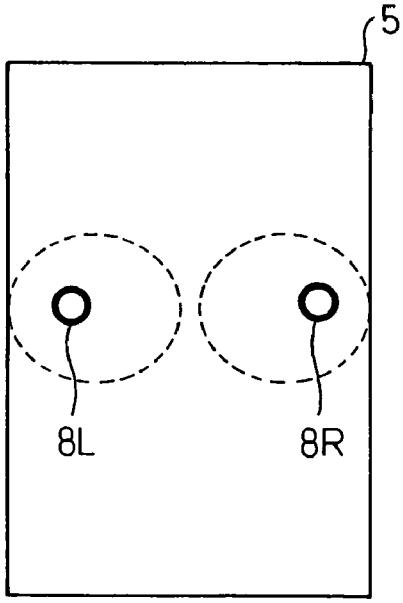
FIG. 19A and FIG. 19B are views for explaining an example of arrangement attaching exciters for board direct drive use to a ceiling interior panel of a vehicle to form a stereo speaker system.
Figure 19B:
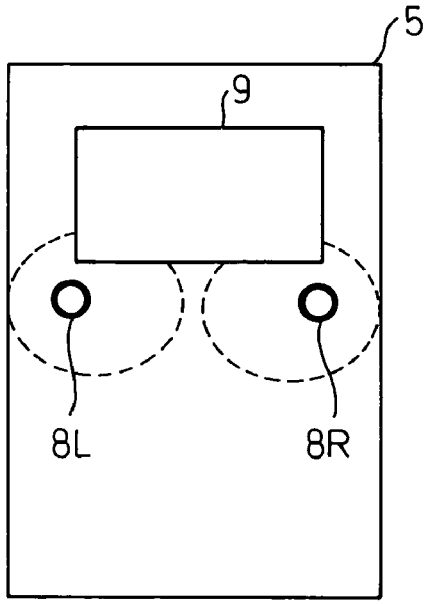

FIG. 18 is a plan view of the exciter 8 seen from the outer yoke 81 side. The cross-section along the line X-X shown here corresponds to the lateral cross-section shown in FIG. 17. In the exciter 8 shown in FIG. 18, three elastic member supports 86-1 to 86-3 are provided, but the number is not limited to three. FIG. 17 shows elastic members 88-1 to 88-3 for elastically supporting the outer yoke 81 and the coupler member 85. These elastic members 88-1 to 88-3 are elastic tabs formed integrally with an elastic member attachment 87 fastened to an end of the side walls of the outer yoke 81. The front end of each is screwed to the corresponding one of the elastic member supports 86-1 to 86-3.

As shown in FIG. 17, a cylindrically shaped bobbin 84 around which the coil is wound is fastened to the coupler member 85. Note that the coil wound around the bobbin 84 is shown by the black parts in the figure. Further, the coil is inserted into the circumferential clearance formed between the inside surface of the side walls of the outer yoke 81 and the outer circumference of the outer yoke 83. When this coil is supplied with a drive signal, the action of the magnetic circuit formed causes vibration to occur corresponding to the frequency of the drive signal. This vibration is transmitted through the coupler member 85 to the interior panel 5.

Since the interior panel 5 itself acts as a vibration board, if the coil is given a drive signal, the interior panel 5 is made to vibrate through the coupler member 85 connected to the bobbin 84 around which the coil is wound and a sound corresponding to the frequency of the signal can be generated. By using the interior panel 5 as a vibration board in this way, formation of a good sound field becomes possible. Further, the exciter 8 shown in FIG. 17 is attached to the bottom surface of the interior panel 5, but the exciter 8, as shown in FIG. 16, can give similar effects as a speaker using a board direct drive exciter even if attached to the top surface of the interior panel 5.

In the exciter for board direct drive use explained above, as shown in FIG. 17, even in the state where the exciter is attached to the interior panel 5, since the elastic member supports 86-1 to 86-3 are provided with certain degrees of height, the outer yoke 81 and the coupler member 85 are arranged separated. Part of the cylindrically shaped side wall of the bobbin 84 is visible from the exciter 8 side. Therefore, the space region formed at the inside of the bobbin 84 communicates with outside space through the circumferential clearance between the outer circumference of the inner yoke 83 and the inner circumference of the bobbin 84 and further the circumferential clearance between the outer circumference of the bobbin 84 and the insider circumference of the side wall of the outer yoke.

If a drive signal is supplied to the coil to make an exciter of such a configuration operate as a speaker, the coil will generate heat. Even in an ordinary voice coil type speaker, in the same way as a board direct drive exciter, there is a space region inside the voice coil and the heat generated by the voice coil may build up in that space region. In the case of this voice coil type speaker, however, the amplitude of the vibration of the voice coil is large, so the heat built up in the space region can be exhausted by air convection and the parts, including the voice coil, will not become high in temperature.

In a board direct drive exciter, however, the space region inside the bobbin is communicated with the outside space. Due to the configuration of the vibration drive, the amplitude of vibration is relatively small, so the air convection generated in the space region due to that vibration will be weak and the built up heat will not be able to be exhausted completely.

Further, when directly attaching the exciter for board direct drive use such as shown in FIG. 17 to for example the interior panel of a vehicle to form a speaker, as explained above, part of the cylindrically shaped side wall of the bobbin 84 will be visible and the space region formed inside the bobbin will be communicated with the outside space. Therefore, dust, dirt, etc. will enter the space region from the outside space. Further, dust, dirt, etc. will accumulate in the circumferential clearance between the outer circumference of the inner yoke 83 and the inner surface of the bobbin 84 or in the circumferential clearance between the outer circumference of the bobbin 84 and the inner circumference of the side walls of the outer yoke. Clogging of these clearances by dust, dirt, etc. will result in the air convection caused by the vibration generated at the time of driving the coil becoming weakened or blocked, so will impair the release of the generated heat and will lead to abnormal noise and disconnection due to rubbing of the voice coil.

Next, embodiments of exciters for board direct drive use according to the present invention will be explained in detail next with reference to the drawings as exciters solving the above problems and achieving the above objects.

Figure 1:
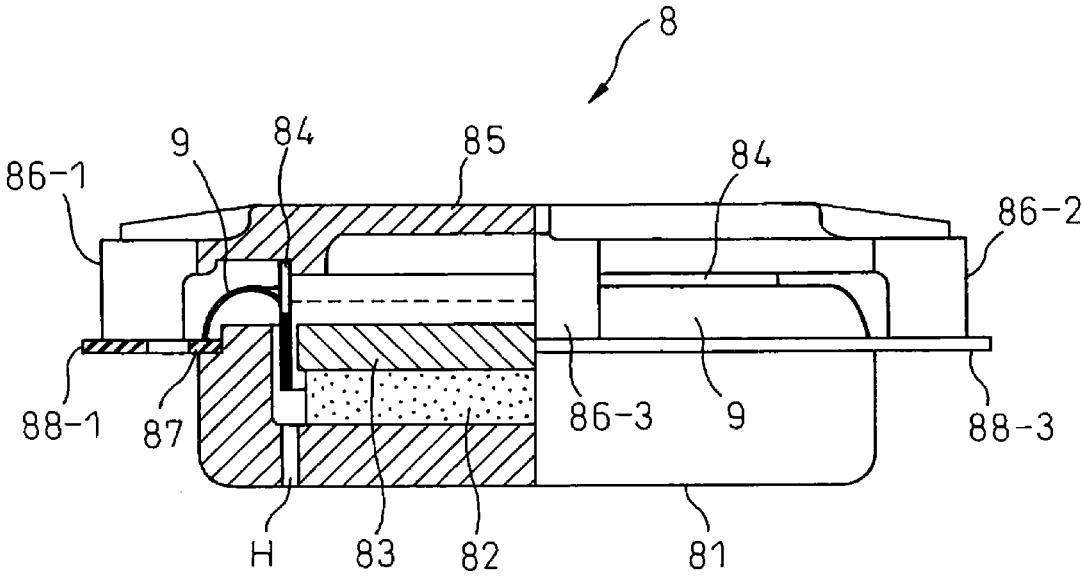
FIG. 1 is a view for explaining a first embodiment of an exciter for board direct drive use according to the present invention.

First, the principle enabling air convection in a device to be efficiently caused by vibration will be explained with reference to an example of the configuration of a board direct drive exciter according to the embodiment shown in FIG. 1. The configuration of the board direct drive exciter shown in FIG. 1 is basically the same as that of the exciter for board direct drive use according to the prior art proposal shown in FIG. 17 and FIG. 18. In FIG. 1, parts the same as those of the exciter shown in FIG. 17 and FIG. 18 are assigned the same reference numerals.

In the exciter for board direct drive use of the prior art proposal, the space region inside the bobbin was communicated with the outside space over its entire circumference through the clearance between the bobbin and outer yoke or inner yoke, so when the amplitude of the vibration driven was small, that vibration did not lead to generation of an effective air convection. Therefore, the built up heat could not be exhausted completely.

Accordingly, in the exciter for board direct drive use of the present embodiment, the inventors took note of the fact that by enhancing the air compression rate due to vibration for the space region formed in the device, it was possible to cause effective generation of air convection and decided to deliberately form a closed space in the device, provide passages for limiting the entry and exiting of air from the closed space along with vibration so as to cause effective air convection, and forcibly air-cool the inside of the device. Further, formation of a closed space in the device also serves as a dustproofing measure since the clearance between the bobbin and outer yoke or inner yoke is kept inside the closed space.

The method of forming the closed space in the exciter is shown in FIG. 1. In the exciter of the prior art proposal, the space region formed inside the bobbin 84 was communicated with the outside space by the circumferential clearance between the bobbin and outer yoke or inner yoke, so to enable a closed space to be formed in the exciter 8, a sealing member 9 is provided between the elastic member attachment 87 and the outside walls of the bobbin 84, whereby the ends of the members are joined over the entire circumference. The state of joining with the outside wall of the bobbin 84 by the sealing member 9 is shown by the broken line in FIG. 1.

The outer yoke 81 and the coupler member 85 are joined by the elastic members 88-1 to 88-3. When the coil wound around the bobbin 84 is supplied with a drive signal, the outer yoke 81 and the coupler member 85 vibrate relative to each other, so when the sealing member 9 is provided between the elastic member attachment 87 and the outer wall of the bobbin 84, it is made one of a shape or material give flexibility so as not to interfere with the vibration due to the elastic members 88-1 to 88-3. For example, it is possible to use a ring-shaped member comprised of a fabric impregnated with a resin, cured, then molded into a curved sectional shape as illustrated and made nonporous.

Note that so long as the exciter 8 can be formed with a closed space, the method of provision of the closed space is not limited to the shape shown in FIG. 1. In FIG. 1, the sealing member 9 was joined to the elastic member attachment 87 and the outside wall of the bobbin 84, but a closed space can be formed inside the exciter 8 even if the top end of the side walls of the outer yoke 81 and the coupler member 85 are joined. In this case as well, the sealing member 9 itself used is made one of a shape or material imparting flexibility and without porosity. Note that if considering improvement of the air compression rate due to vibration, it is preferable to arrange the sealing member so as to make the closed space formed as small as possible.

Next, to enable the air residing in the closed space formed in the device to be replaced with air of the outside space, passages enabling air to enter and exit between the closed space and outside space along with vibration are provided in the device. When the coil is supplied with a drive signal and the outer yoke 81 vibrates in the direction of the coupler member 85, the closed space in the device is compressed in accordance with the amplitude of vibration. By provision of the passages, the compressed air is easily exhausted into the outside space. Therefore, effective air convection is generated in the closed space and heat generated in the device is easily dissipated.

As explained above, by forming a closed space in the device and providing passages connecting the space and the outside space, unlike the case of a conventional voice coil type speaker, even if the amplitude of vibration is relatively small due to the structure of the device, the air compression rate due to the vibration of the device is improved. Further, the exiting of air from the closed space to the outside space is limited by the passages, so effective air convection is generated along with vibration of the device. This air convection functions to forcibly air-cool the inside of the closed space, whereby the heat generated in the device is efficiently dissipated. Further, forming a closed space between the outer yoke and coupler member also serves as a dustproofing measure in the device.

Next, regarding the method of forming passages between the closed space formed in the device by the sealing member and the outside space, specific examples of the exciter will be explained with reference to FIG. 2 to FIG. 9 divided into a first embodiment and a second embodiment. The first embodiment is the case of attachment of the exciter to a board member without the use of a bracket member. The second embodiment is the case of use of a bracket member. The exciters of the examples shown from FIG. 2 to FIG. 9 are shown by enlarged views of only the parts relating to the lateral cross-section of the left half of the exciter 8 shown in FIG. 1. The same parts are assigned the same reference numerals.

Figure 2:
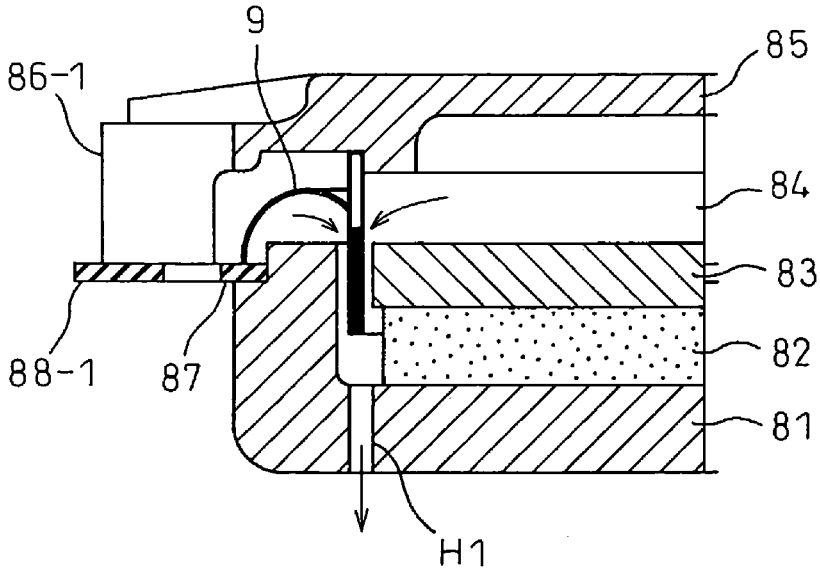
FIG. 2 is a cross-sectional view for explaining Example 1 of an exciter according to a first embodiment.

FIG. 2 shows Example 1 according to the first embodiment in the case where the passages are through holes in the outer yoke 81 forming part of the exciter. In Example 1, the through holes H1 are provided in the bottom of the outer yoke 81 at the outer circumference of the permanent magnet 82. The number of the through holes H1 is selected so as to generate the optimal air convection in accordance with the air compression rate for the size of the closed space of the device. If the closed space is large, the number of through holes is small, for example, as little as one, while if the closed space is formed small, for example, through holes are provided at four or more locations. In the case of through holes at a plurality of locations, they may be arranged along the periphery of the bottom of the outer yoke 81.

Further, in FIG. 2, the example was shown of the through holes H1 provided at the bottom of the outer yoke 81, but they can also function as passages between the closed space and the outside space even if provided at the side walls of the outer yoke 81. In this case as well, the method of determination of the number of the through holes is similar to that when provided at the bottom of the outer yoke 81.

In Example 1, by the provision of the through holes H1, the air in the space region inside the bobbin 84 of the closed space and the space region surrounded by the sealing member 9 and the bobbin 84 are compressed by vibration of the device, whereby air convection shown by the arrows in FIG. 2 is generated and heated air is exhausted from the through holes H1 to the outside space. Next, due to the vibration in the opposite direction of the device, the air of the outside space is sucked in from the through holes H1, so forced air cooling in the device is realized.

Figure 3:
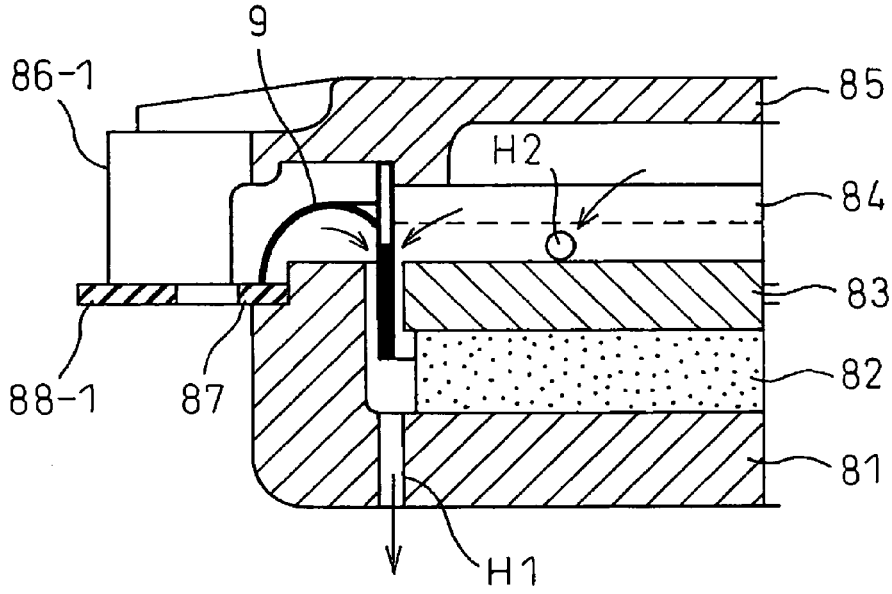
FIG. 3 is a cross-sectional view for explaining a modification of Example 1 of an exciter according to the first embodiment.

Next, a modification of Example 1 shown in FIG. 2 is shown in FIG. 3. In Example 1, through holes H1 were provided at the peripheral edge of the bottom of the outer yoke 81, but sometimes the amounts of air differ between the space region inside the bobbin 84 and the space region formed by the sealing member 9 and the outer circumference of the bobbin 84. For example, when the space region inside the bobbin 84 is large, since the amplitude of vibration of the device is the same for the two, the extents of air compression to the regions will differ and the air compression rate for the space region inside the bobbin 84 will drop.

In such a case, it is sufficient to provide the bobbin 84 itself with through holes H2 connecting the space region inside the bobbin 84 and the space region surrounded by the sealing member 9 and the bobbin 84. The number of the through holes H2 may be suitably selected from one up. The through holes H2 have the function of adjusting the air compression rate when there is a difference in the air compression rate between two space regions dividing a closed space formed in the device, enable the air compression rate of the device as a whole to be improved, and facilitate generation of effective air convection.

Note that the through holes H2 are provided below the line connecting the sealing member 9 and the bobbin 84 shown by the broken line in FIG. 3 so as to adjust the pressure between the two divided space regions in the closed space. If providing the through holes H2 above the connection line, since the part of the bobbin 84 above the connection line faces the outside space, the through holes H2 have the function of connecting the space region inside the bobbin 84 and the outside space. The through holes H2 in this case can exhibit similar effects as the through holes H1.

On the other hand, the through holes H1 provided in Example 1 shown in FIG. 2 and the modification of Example 1 shown in FIG. 3 were all holes of the same size in opening to the closed space and opening to the outside space and having the same diameters. Therefore, in Example 2 of the passages shown in FIG. 4, depending on the sizes of the openings of the through holes H1, there is a possibility of dust, dirt, etc. being sucked in from the outside space, so through holes H3 comprised of the through holes H1 treated for dustproofing were provided at the outer yoke 81.

Figure 4:
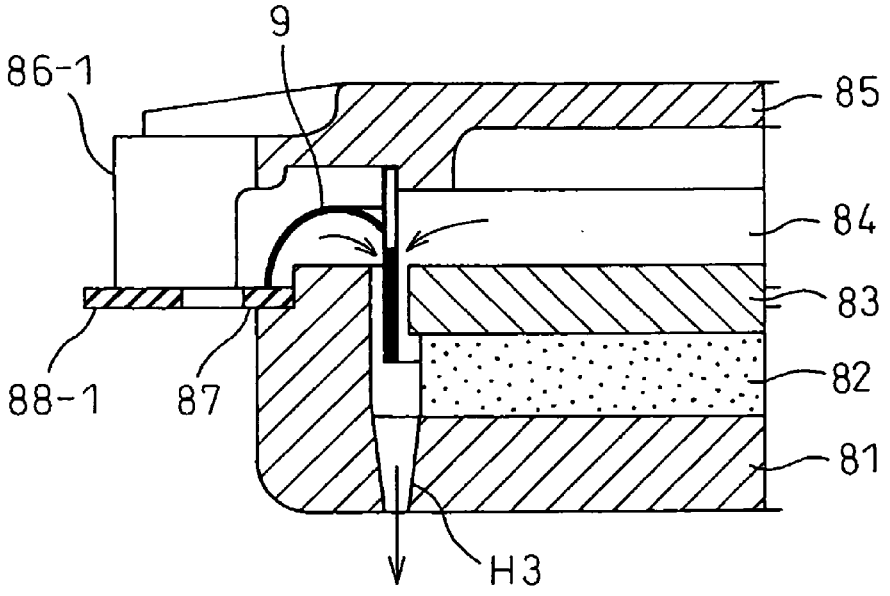
FIG. 4 is a cross-sectional view for explaining Example 2 of an exciter according to the first embodiment.

In Example 2 shown in FIG. 4, the area of the opening facing the outside space in each through hole H3 provided at the outer yoke 81 is made smaller than the opening facing the closed space. Therefore, as shown by the arrows in FIG. 4, when compressing the closed space by vibration of the device, it is possible to smoothly generate effective air convection, but conversely when air is sucked into the closed space by vibration of the device, since the openings of the through holes are narrowed, dust, dirt, etc. can be kept from being sucked in from the outside space, whereby dustproofing is achieved.

Figure 5:
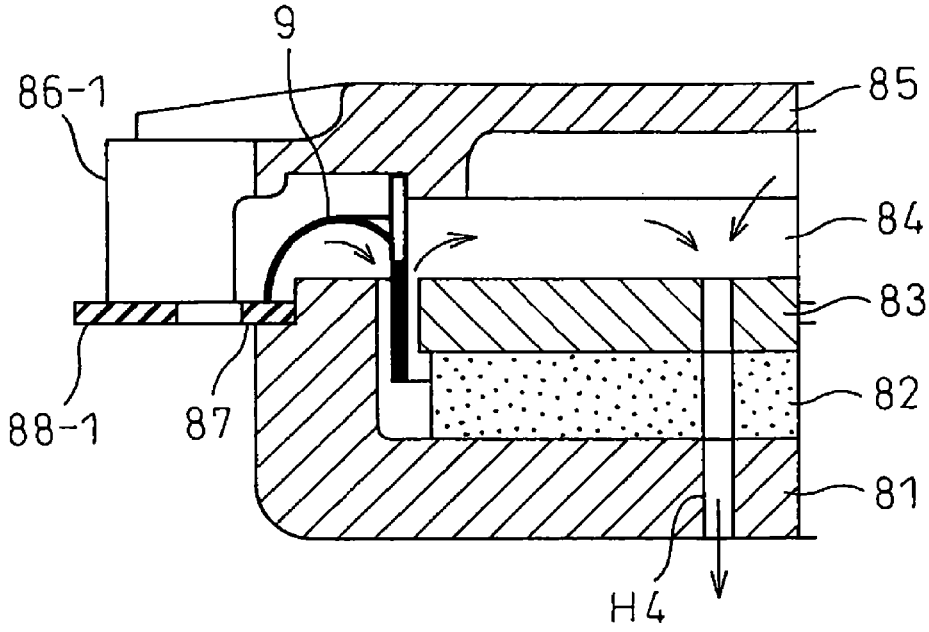
FIG. 5 is a cross-sectional view for explaining Example 3 of an exciter according to the first embodiment.

In Examples 1 and 2 explained up to here, the through holes serving as the passages were provided at the periphery of the outer yoke, but FIG. 5 shows provision of through holes serving as passages at the bottom of the outer yoke, that is, the inside from the periphery of the outer yoke. In the case of Examples 1 and 2, the air of the space region inside the bobbin 84 forms air convection passing through the circumferential clearance between the inner yoke 83 and the bobbin 84 and is exhausted to the exterior space through the through holes H4. In Example 3 shown in FIG. 5, however, through holes H4 passing through the three layers of the outer yoke 81, permanent magnet 82, and inner yoke 83 and directly connecting the space region inside the bobbin 84 and the outside space are provided.

In the case of Example 3, the air of the space region formed by the sealing member 9 and the outer circumference of the bobbin 84, as shown by the arrows in FIG. 5, moves to the space region inside the bobbin 84 through the clearance between the inner circumference of the side walls of the inner yoke 81 and the outer circumference wall surface of the coil of the bobbin 84 and the circumferential clearance between the inside circumference of the coil of the bobbin 84 and the outer circumference of the inner yoke 83 due to the vibration of the device. Therefore, the number and diameter of the through holes H4 are adjusted so that effective air convection is generated. Regarding the positions for provision of the through holes H4, in the case of a thick one, it is sufficient to provide a single through hole at the center. Further, when providing a plurality, as shown in FIG. 5, they are arranged so as to surround the center.

Figure 6:
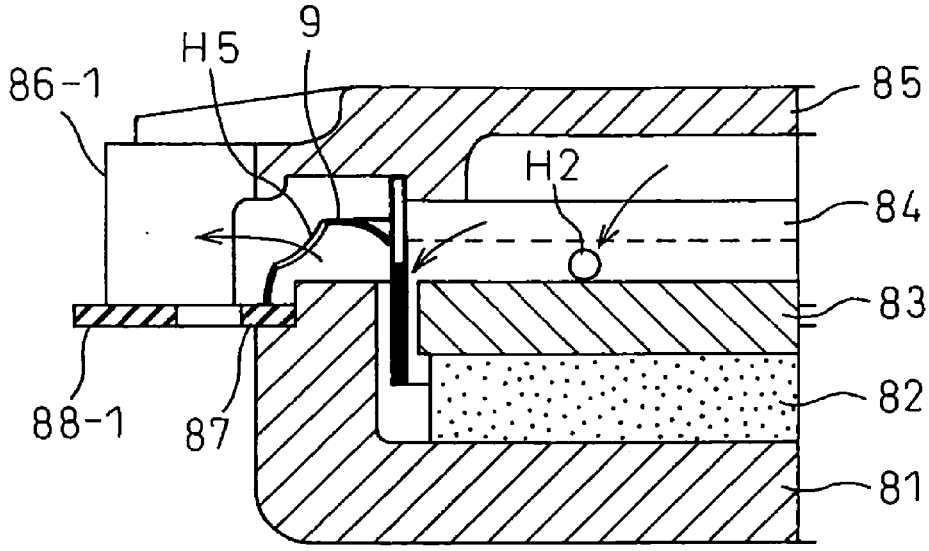
FIG. 6 is a cross-sectional view for explaining Example 4 of an exciter according to the first embodiment.

In Examples 1 to 3 explained up to here, the through holes H1 or H4 were provided at the outer yoke 81, but as shown in Example 4 shown in FIG. 6, it is also possible to provide through holes as passages in the sealing member 9 itself. That is, through holes H5 for directly connecting the space region formed by the sealing member 9 and the outer circumference of the bobbin 84 and the outside space are provided at the sealing member 9.

In the case of Example 4, the air of the space region inside the bobbin 84 moves to the outside space due to the air convection passing through the circumferential clearance between the inner circumference of the coil of the bobbin 84 and the outer circumference of the inner yoke 83 and the circumferential clearance between the inner circumference of the side walls of the outer yoke 81 and the outer circumference of the coil of the bobbin 84, so to improve the efficiency of heat dissipation, as shown in FIG. 6, the walls of the bobbin 84 are also provided with the through holes H2 shown in FIG. 3.

Figure 7:
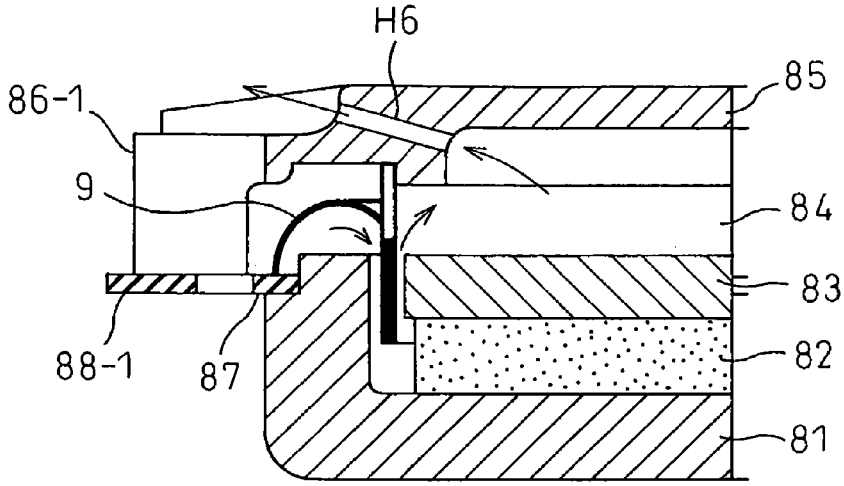
FIG. 7 is a cross-sectional view for explaining Example 5 of an exciter according to the first embodiment.

Next, Example 5 providing the above passages in the coupler member 85 is shown in FIG. 7. As shown in FIG. 7, the space region formed inside the bobbin 84 is also defined by the surface of the coupler member 85 opposite to the surface contacting the interior panel 5, so by providing the through holes H6 at the outer circumference part of the coupler member 85, the space region inside the bobbin 84 is communicated with the outside space by the through holes H6. The method of determining the number of the through holes H6 is similar to the case of Example 3 shown in FIG. 5.

Note that the exciter for board direct drive use according to the first embodiment explained up to here has been predicated on the coupler member being attached directly to the surface of the interior panel. In actuality, however, if the coupler member is attached directly to the interior panel, the exciter itself will end up being fixedly attached and the problem will arise a drop in serviceability when replacing or removing the exciter. Therefore, in the second embodiment, to deal with this problem, the exciter is detachably attached to the board member. The internal panel is fixed with a bracket member having a male engagement part and the coupler member is provided with a female engagement part able to engage with the male engagement part of this bracket member. The bracket member is usually made of plastic, so if the present embodiment is applied, it helps in prevention of heat deformation and therefore is convenient.

Figure 8:
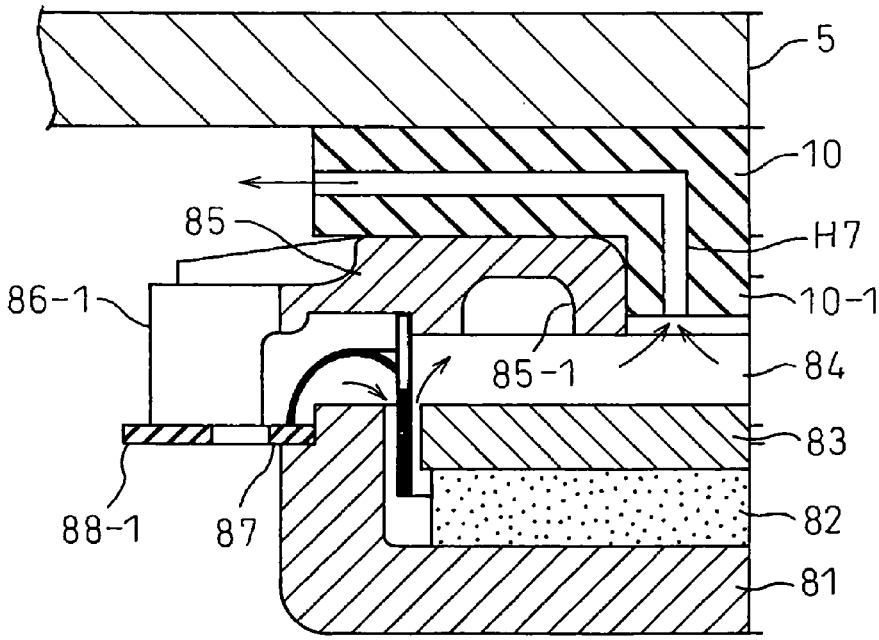
FIG. 8 is a cross-sectional view for explaining Example 6 according to a second embodiment of an exciter according to the present invention.

Example 6 of an exciter according to a second embodiment attaching the coupler member to the interior panel through this bracket member is shown in FIG. 8. The basic configuration of the exciter is the same as the other examples. The same parts are assigned the same reference numerals. However, this differs in the point that the coupler member 85 is formed with a female engagement part 85-1. The female engagement part 85-1 is for example a threaded part for screwing with a male engagement part 10-1 formed integrally with the bracket member 10. FIG. 8 shows the state where the exciter is attached to the interior panel 5 through the bracket member 10.

Here, in the exciter of the type attached to an interior panel through a bracket member 10, the space region inside the bobbin 84 formed in the device is defined by the inner circumference of the bobbin 84, the top surface of the inner yoke 83, the inside surfaces of the coupler member 85, and the end face of the male engagement part 10-1 of the bracket member 10. Therefore, if providing through holes inside the bracket member 10, connection of the space region at the inside of the bobbin 84 and the outside space becomes possible.

In Example 6 shown in FIG. 8, the thinking in providing the passages for forming effective air convection is the same as in Example 5 shown in FIG. 7. Instead of the through holes H6 provided at the bracket member 85, it is possible to provide L-shaped through holes H7 passing through the bracket member 10. Note that when attaching the board direct drive exciter to an internal panel through the bracket member 10, it is not always necessary to provide the through holes H7. When provision of passages according to the other examples explained above is sufficient, there is no need to provide the through holes H7 in the bracket member. Of course, employing Example 6 together with other examples is effective for generating effective air convection.

In Example 6 shown in FIG. 8, the fact that when attaching the exciter to a board member using a bracket member, it is possible to provide through holes in the bracket member to generate effective air convection was explained, but, next, generation of effective air convection by a method other than provision of through holes in the bracket member, that is, by specially designing the shape of the bracket member, will be explained with reference to FIG. 9.

Figure 9:
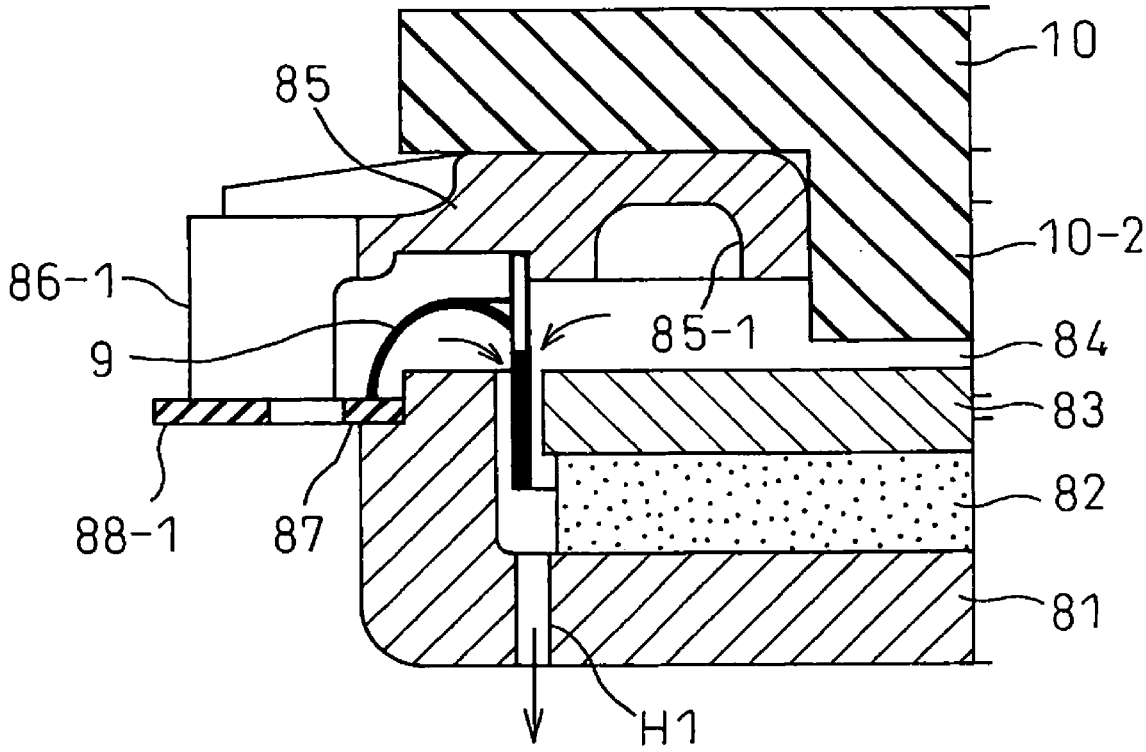
FIG. 9 is a cross-sectional view for explaining Example 7 of an exciter according to the second embodiment.

The exciter according to Example 7 of the second embodiment shown in FIG. 9 is the same in configuration as the exciter of Example 1 shown in FIG. 2 except for being attached to the interior panel 5 through a bracket member 10. The same parts are assigned the same reference numerals. In Example 7 shown in FIG. 9, the coupler member 85 is formed with a female engagement part 85-1. A male engagement part 10-2 formed integrally with the bracket member 10 is for example engaged with a threaded part provided at the female engagement part 85-1, whereby the coupler member 85 is attached detachably to the bracket member 10.

Here, when the male engagement part 10-2 of the bracket member 10 engages with the female engagement part 85-1 of the coupler member 85 for attachment, the front end of the male engagement part 10-2 goes beyond the female engagement part 85-1 and sticks out into the space region inside of the bobbin 84 by the male engagement part 10-2 being designed long. By the front end of the male engagement part 10-2 sticking out into the space region inside the bobbin 84, the volume occupied by the space region can be made smaller and the air compression rate for the amplitude of vibration of the device is further improved as effects. Therefore, even if the amplitude of vibration of the device is small, effective air convection easily occurs. Note that Example 7 of FIG. 9 is shown with reference to the case of use of the bracket member for Example 1, but it is also possible to employ the method of provision of through holes according to the other examples.

As explained above, in the exciter according to the first and second embodiments, by providing the sealing member and forming the closed space in the device, it is possible to improve the air compression rate even for vibration of a small amplitude due to the device structure. In improving the air compression rate, passages for connecting the closed space and the outside space are provided and air convection effective for making the heat generated inside the device move to the outside space is caused, whereby forced air cooling of the device is realized.

Note that regarding the method of provision of the passages, the explanation was given showing Examples 1 to 6 individually, but it is also possible to combine and employ two or more of the examples. Further, opening areas of the through holes forming the passages may be suitably adjusted. Further, for Examples 1 to 7, the explanation was given of the case of the exciter or bracket member attached to the interior panel of a vehicle, but the exciter according to the present embodiment is not limited to the case of attachment to the interior panel of a vehicle and may also be applied to the case of attachment to a board member having a suitable area and enabling propagation of the vibration of the exciter.

In Examples 1 to 7 according to the first and second embodiments explained above, the sealing member 9 attached to the exciter, as explained above, was made one of a shape or material giving a flexibility not inhibiting vibration of the vibrator supported by the elastic members 88-1 to 88-3 when provided between the elastic member attachment 87 and the outer wall of the bobbin 84, for example, was a ring-shaped member obtained by impregnating a fabric with a resin, curing it, then molding it to a curved cross-sectional shape as illustrated and made free of porosity. Further, the sealing member 9 was joined using an adhesive to the outer wall of the bobbin 84 and the elastic member attachment 87 or the top end of the side walls of the outer yoke 81, whereby a closed space was formed in the exciter 8.

However, the sealing member 9 comprised of fabric impregnated with a resin and cured is joined by an adhesive with the outer wall of the bobbin 84 and the elastic member attachment member 87 or the top end of the side walls of the outer yoke 81, so the assembly work of the exciter 8 is complex. On the other hand, in maintaining the air-tightness of the closed space in the exciter, even if the adhesion between the sealing member and the object joined to is good, the heat resistance and durability of the sealing member itself have to be further improved.

Here, in the sealing member 9 shown in Examples 1 to 7, instead of using fabric impregnated with a resin and cured, it is also possible to use the superior heat resistance and durability fluororubber, silicone rubber, etc. The sealing member 9 shown in Examples 1 to 8 is joined by an adhesive to the bobbin 84 and elastic member attachment 87 or the top end of the side walls of the outer yoke 81.

Figure 10A:
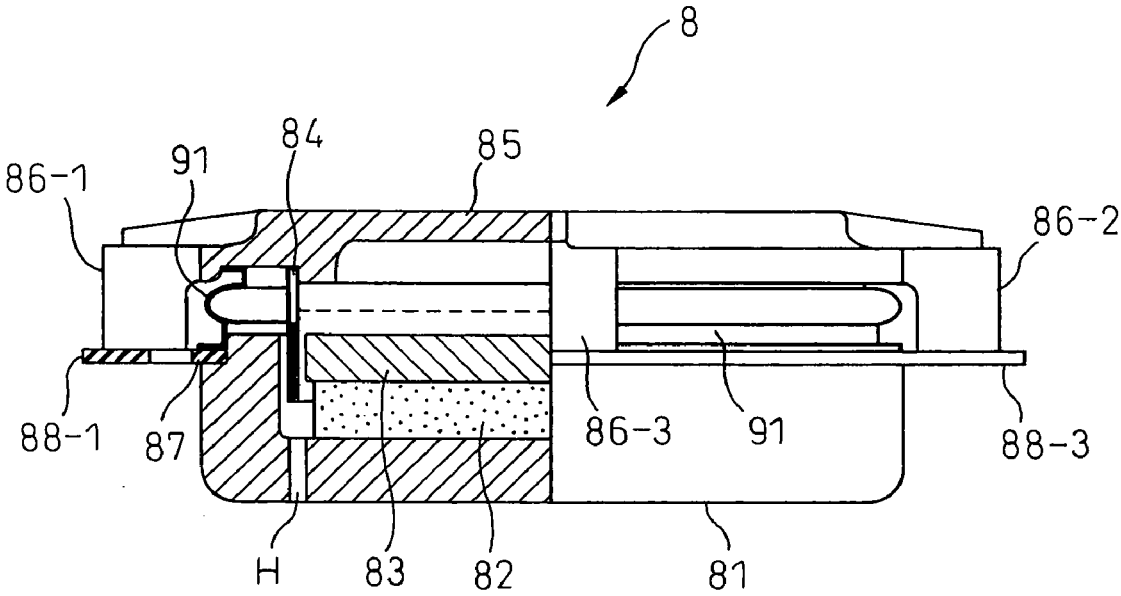
FIG. 10A and FIG. 10B are views for explaining Example 8 according to a third embodiment of an exciter for board direct drive use according to the present invention.
Figure 10B:
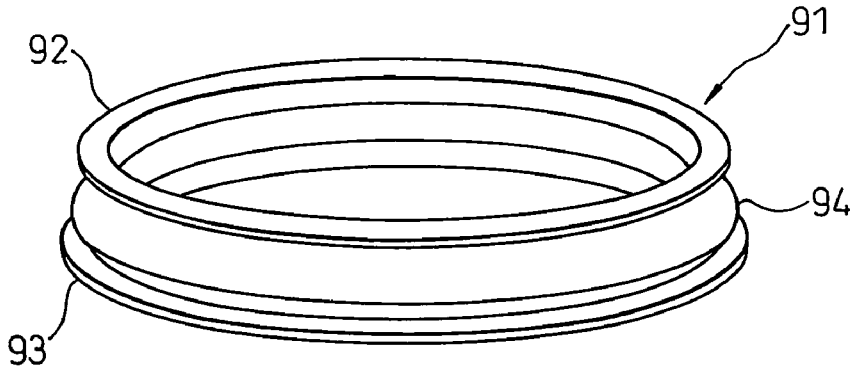
Figure 11:
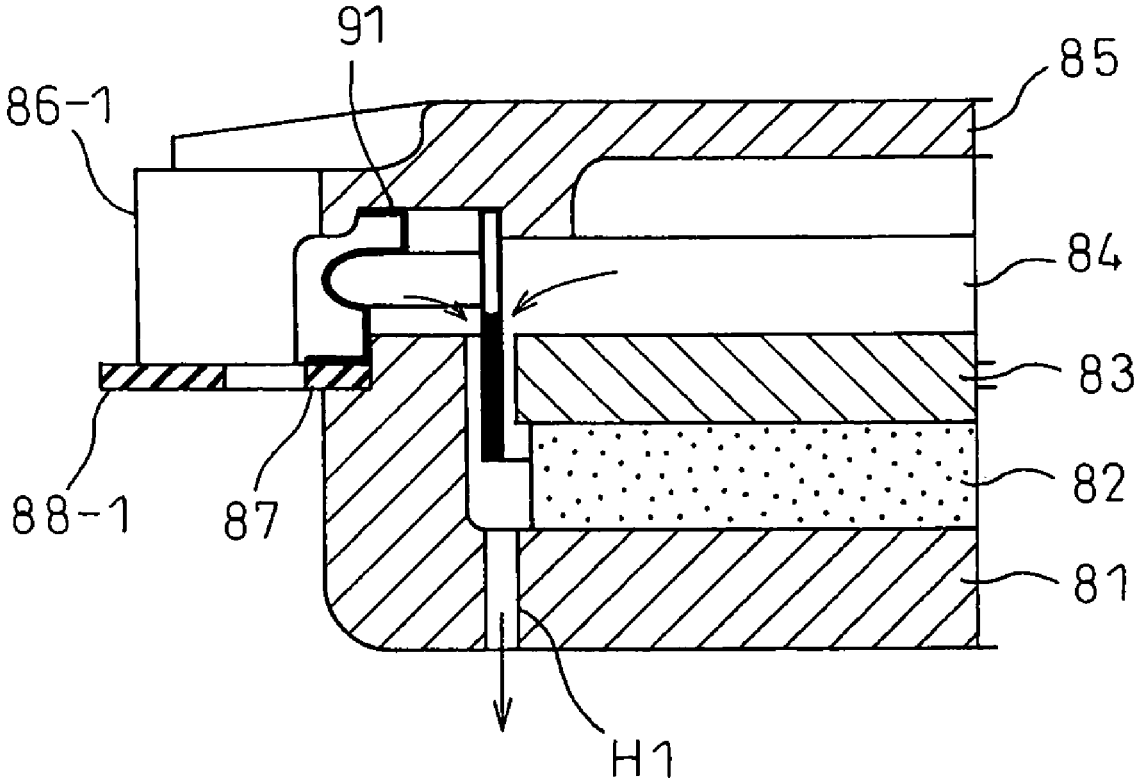
FIG. 11 is an enlarged cross-sectional view of an exciter in Example 8 shown in FIG. 10A.

A speaker using a sealing member improving the work efficiency of the assembly of the device and improving the heat resistance and durability is shown as Example 8 according to the third embodiment in FIG. 10A, FIG. 10B, and FIG. 11. FIG. 10A shows the state where a sealing member 91 having a shape different from the sealing member 9 used in Examples 1 to 7 is attached inside the exciter 8. FIG. 10B is a bird's eye view of the sealing member 91 before assembly into the exciter 8. Further, FIG. 11 is an enlarged view of only the part relating to the lateral cross-section of the left half of the exciter 8 shown in FIG. 10A. Here, FIG. 10A and FIG. 11 show parts the same as those of the exciter 8 shown in FIG. 1 to FIG. 9 with the same reference numerals.

Details of the sealing member 91 attached to the exciter 8 according to Example 8 are shown in FIG. 10B. The sealing member 91, considering heat resistance and durability, is integrally formed by a fluororubber or silicone rubber having flexibility. The shape of the member body is made an O-ring shape overall. One end edge of the member body is provided with an end face 92 to be joined with the outer circumference of the coupler member 85. The other end edge of the member body is provided with an end face 93 to be joined with the entire circumference of the elastic member attachment 87 or the entire circumference of the end of the side walls of the outer yoke 81. By making the shape of the sealing member an O-ring shape, at the time of assembly of the exciter, assembly becomes possible by successively stacking the parts forming the exciter and the work efficiency of assembly of the exciter is improved.

The member body is provided with a bulge 94 formed integrally with the end face 92 and end face 93. Due to the presence of this bulge 94, in addition to the flexibility due to the material of the member body proper, a flexibility not obstructing vibration of the vibrator supported by the elastic members 88-1 to 88-3 can be imparted. Further, the height of the bulge 84 is adjusted to a suitable size so that the distance between the end face 92 and the end face 94 becomes somewhat greater than the interval between the coupler member 85 and the elastic member attachment 87 or the end of the side walls of the outer yoke 81.

If designing the closed space 91 in this way, when assembling the exciter, the end face of the closing member 91 is pressed against by the coupler member 85, the elastic member attachment 87, or the end of the side walls of the outer yoke 81. After the exciter finishes being assembled, the elasticity of the sealing member 91 acts and the closeness of fit of the end face 92 with respect to the entire outer circumference of the coupler member 85 or the closeness of fit of the end face 93 with respect to the entire circumference of the end of the side walls of the outer yoke 81 can be improved. Note that in attaching the sealing member 91, an adhesive is used to fasten the sealing member 91 to the inside of the exciter 8.

The exciter of Example 8 shown in FIG. 10A and FIG. 11 is the case where a sealing member 91 is assembled between the coupler member 85 and the elastic member attachment 87. The lateral sectional shape of the sealing member 91 is shown by the bold solid line. The method of dissipation of heat of the exciter 8 of the illustrated Example 8 is similar to that of the case of Example 1. The state is shown in FIG. 11.

In Example 8, as the above-mentioned passages, through holes H1 are provided at the bottom of the outer yoke 81 at locations positioned at the outer circumference of the permanent magnet 82. The number of the through holes H1 is selected so that the optimum air convection occurs in accordance with the air compression rate for the size of the closed space in the device. If the closed space is large, the number of through holes is small, for example, a single location. If the closed space is formed small, for example, the through holes can be provided at four or more locations. In the case of a plurality of locations of through holes, arrangement along the periphery of the bottom of the outer yoke 81 is also possible.

Due to the sealing member 91, a closed space is formed in the device. By providing through holes H1 as passages connecting this space and the outside space, even if the extent of vibration is relatively small due to the structure of the device, the air compression rate due to the vibration of the device is improved and the exit of the air from the closed space to the outside space is restricted by the passages. Due to this, as shown by the arrow in FIG. 11, effective air convection is formed along with vibration of the device, the air convection functions as forced air cooling in the closed space, and the heat generated inside the device is efficiently dissipated. Further, formation of the closed space between the outer yoke and coupler member also forms a dustproofing means in the device.

The sealing member 91 used in Example 8 according to the third embodiment explained above may replace the sealing members 9 used in the exciters 8 of Examples 1 to 7 according to the first and second embodiments. The work efficiency when assembling the exciters 8 of the examples can be improved and further the heat resistance and durability of the exciters can be improved.

Next, a speaker for realizing the above other object will be explained as a fourth embodiment with reference to FIG. 12 to FIG. 14. In the fourth embodiment, an exciter is directly attached to a board member so as to form a speaker.

As explained above, when using a conventional board direct drive exciter to make a speaker, if for example employing an interior panel of a vehicle as the board member, the vibration properties, shape, and other specifications of the exciter have been determined in accordance with the specifications of the interior panel or the properties of the stereo reproduction space and the exciter has to be produced in accordance with those specifications. Therefore, when having to be attached to interior panels of different specifications, for example, when sunroofs were provided, if the produced exciters of the same specifications were attached as they were, the opening parts of the sunroofs would affect the propagation of vibration energy from the exciters and as a result caused a difference in sound quality in the stereo reproduction space.

Therefore, in the speaker using an exciter for board direct drive use according to the present invention, to enable exciters of the same specifications to be used for board members of different specifications without changing in the sound quality of the output sound, vibration limiting members for limiting the spread of the vibration energy from the exciter are arranged predetermined distances from the exciter on the surface of the board member.

By arranging the vibration limiting members, even if attaching exciters of the same specifications to different specification board members, the board members are made to vibrate by the same conditions and the conditions for emission of sound from the board members can be made similar. Therefore even if using exciters of the same specifications, no difference in sound quality will be caused between board members of different specifications to which the exciters are attached. Consequently, it is made possible to use exciters of common specifications for different specification board members.

Below, a speaker of the present invention will be shown as a fourth embodiment. Taking as an example the case of using an interior panel of a vehicle as a vibration board, the explanation will be given divided into Example 9 to Example 11 according to the method of arrangement of the vibration limiting members.

Figure 12:
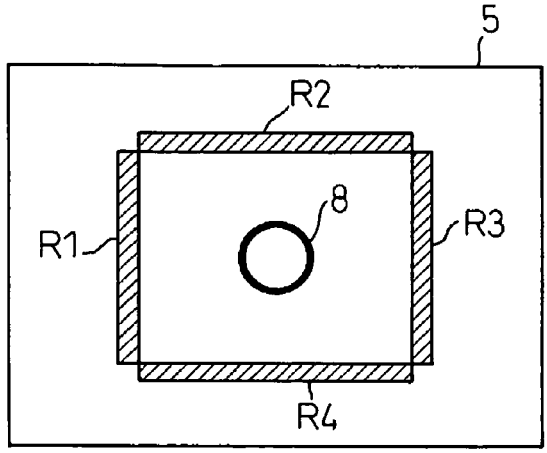
FIG. 12 is a view for explaining Example 9 according to a fourth embodiment of a speaker utilizing the exciter for board direct drive use according to the present invention.

FIG. 12 shows the case of use of vibration isolation rubber as the vibration limiting members in the fourth embodiment as Example 9. In this figure, the part of the interior panel 5 of the vehicle including the peripheral part of the exciter 8 through which the vibration energy is propagated is shown. The exciter 8 employed can be the above conventional exciter for board direct drive use. By employing vibration isolation rubber, it is possible to absorb the vibration energy which had been propagated through the interior panel 5, so the vibration energy is not propagated further than the vibration limiting members as seen from the exciter 8.

On the surface of the interior panel 5, the bar-shaped vibration limiting members R1 to R4 formed by vibration isolation rubber are arranged predetermined distances away and fastened by adhesion etc. so as to surround the exciter 8 attached to the interior panel 5. In Example 9 shown in FIG. 12, the vibration limiting members R1 to R4 are bar-shaped, so the range of propagation of the vibration energy becomes rectangular as a whole, but it is not always necessarily a rectangular shape. A circular shape is also possible. Further, if restricting the range of propagation of vibration energy of the exciter 8 to a specific direction, when even interior panels of different specifications can be handled, the exciter 8 does not have to be completely surrounded. It is sufficient to arrange and fasten the vibration limiting members a predetermined distance away in that specific direction.

In this way, by arranging and fastening vibration limiting members formed from vibration isolation rubber at the surface of the interior panel at the vicinity of the exciter predetermined distances away from the exciter, it is possible to limit propagation of vibration energy. Therefore, regardless of any sunroof, the same vibration conditions can be realized, so employment of an exciter of common specifications becomes possible and the sound quality in the stereo reproduction space formed can be prevented from becoming different between the case of an interior panel provided with a sunroof and the case of an interior panel with no sunroof.

Note that in Example 9 shown in FIG. 12, the case is shown where the vibration limiting members are arranged and fastened at the same surface as the surface where the exciter is attached, but there is the effect of limitation of propagation of vibration energy even if arranging and fastening the vibration limiting members at the surface at the opposite side to the surface where the exciter is attached.

Figure 13A:
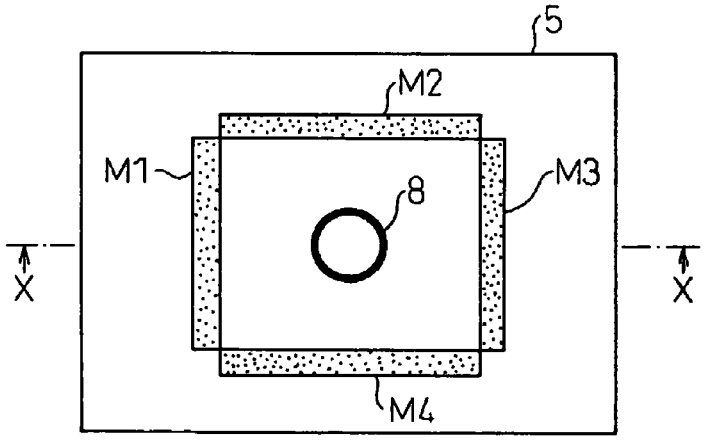
FIG. 13A and FIG. 13B are views for explaining Example 10 of a speaker according to a fourth embodiment.
Figure 13B:
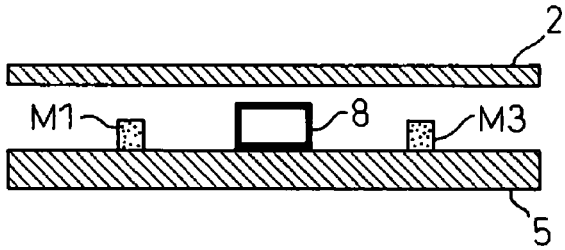

FIGS. 13A and 13B illustrate the case of using permanent magnet materials for the vibration limiting members in the present embodiment as Example 10 of the speaker. FIG. 13A, like FIG. 12, shows the part of the interior panel 5 of a vehicle including the peripheral part of the exciter 8 where vibration energy is propagated. The exciter 8 employed may be the above-mentioned exciter for board direct drive use of the prior art. In Example 10 shown here, instead of the vibration isolation rubber in Example 9, vibration limiting members M1 to M4 employing permanent magnet materials are used. FIG. 13B shows a lateral cross-section along the line X-X shown in FIG. 13A. In FIG. 13B, the cut cross-section of the ceiling part of a vehicle appears. The exciter 8 is attached to the surface of the interior panel 5 at the exterior panel 2 side.

On the surface of the interior panel 5, the bar-shaped vibration limiting members M1 to M4 formed by permanent magnets or magnetic members obtained by magnetizing polymer materials containing ferrite or other magnetic powder as the permanent magnet material, like in the case of FIG. 12, are arranged predetermined distances away and fastened by adhesion etc. so as to surround the exciter 8 attached to the interior panel 5. In Example 10 shown in FIG. 13, the vibration limiting members M1 to M4 are bar-shaped, so as in the case of FIG. 12, the range of propagation of the vibration energy becomes rectangular as a whole, but it is not always necessarily a rectangular shape. A circular shape is also possible. Further, if restricting the range of propagation of vibration energy of the exciter to a specific direction, when even interior panels of different specifications can be handled, the exciter 8 does not have to be completely surrounded. It is sufficient to arrange and fasten the vibration limiting members predetermined distances away in that specific direction.

Here, in the case of Example 10 of FIG. 13A, instead of the vibration isolation rubber used in Example 9 of FIG. 12, a permanent magnet material is used for the vibration limiting members. The force of attraction of iron of the vibration limiting members is used to limit the propagation of the vibration energy from the exciter to the board. Therefore, when using an interior panel of a vehicle as the vibration board, as shown in FIG. 13B, the interior panel is arranged in parallel with the iron exterior panel 2. The closer the surfaces of the vibration limiting members M1 to M4, at the opposite sides to the surfaces where the vibration limiting members are fastened to the interior panel 5, to the exterior panel 2, the greater the effect of limitation of the vibration energy.

As explained above, by arranging and fastening vibration limiting members formed by a permanent magnet materials to the surface of an interior panel in the vicinity of the exciter predetermined distances away from the exciter, it is possible to limit propagation of the vibration energy. Therefore, by specially designing the method of arrangement of the vibration limiting members, it is possible to realize the same vibration conditions regardless of any sunroof, so employment of an exciter based on common specifications becomes possible. The sound quality in the stereo reproduction space formed can be prevented from becoming different between the case of an interior panel provided with a sunroof and the case of an interior panel with no sunroof.

Note that as shown in FIG. 13B, the vibration limiting members in Example 10 were arranged and fastened at the same side as the surface of attachment of the exciter, but as shown by the broken line in FIG. 15, when the exciter 8 is attached to the bottom surface of the interior panel 5, if arranging and fastening the vibration limiting members to the top surface of the interior panel 5 at the opposite side from the surface of attachment of the exciter, there is the effect of limitation of propagation of the vibration energy.

In the case of Example 9 and Example 10 explained above, the vibration limiting members were fastened to the surface of a board member serving as the vibration board, but in Example 11 of the speaker according to this embodiment, instead of the vibration limiting members being fastened to a board member serving as the vibration board by adhesion etc., the vibration limiting members are fastened pressed against the board member so as to limit propagation of the vibration energy.

Figure 14A:
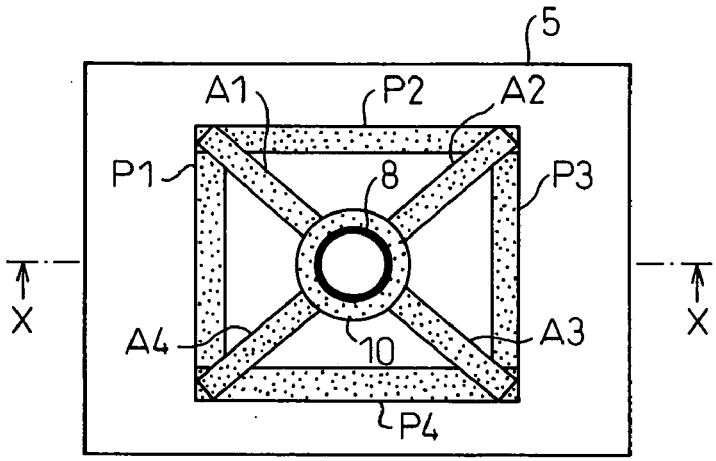
FIG. 14A and FIG. 14B are views for explaining Example 11 of a speaker according to a fourth embodiment.
Figure 14B:
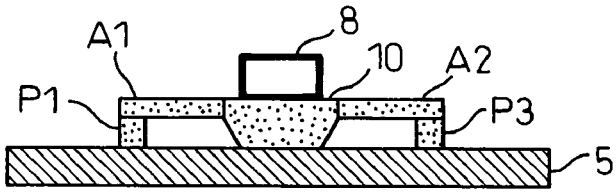

The case of Example 11 is shown in FIG. 14A and FIG. 14B. FIG. 14A shows the state of a board direct drive speaker similar to FIG. 1. The vibration limiting members P1 to P4 are pressed against the interior panel 5 serving as the vibration board. Arm members A1 to A4 for pressing the exciter 8 against the interior panel 5 are provided at a coupler member 10 for mounting the exciter 8. The coupler member 10 is attached to the surface of the interior panel 5 and supplies the vibration energy from the exciter 8 to the interior panel 5.

The vibration limiting members P11 to P4 may be integrally formed with the coupler member 10 and arm members A1 to A4. Further, they may be separate, in which case the vibration limiting members P1 to P4 are fastened to the front ends of the arm members A1 to A4. In any case, the arm members A1 to A4 are configured so that when the coupler member 10 is attached to the surface of the interior panel 5, the vibration limiting members P1 to P4 are pressed against the interior panel 5 by a predetermined pressing force.

As explained above, by pressing vibration limiting members against the interior panel in the vicinity of the exciter at predetermined distances away from the exciter, it is possible to limit propagation of vibration energy. Therefore, regardless of any sunroof, the same vibration conditions can be realized, so employment of an exciter of common specifications becomes possible and the sound quality in the stereo reproduction space formed can be prevented from becoming different between the case of an interior panel provided with a sunroof and the case of an interior panel with no sunroof.

Note that as shown in Examples 9 to 11 of the fourth embodiment explained up to here, the example was given of a speaker using an exciter for board direct drive use which uses the interior panel of a vehicle as the vibration board, but the board member to which the exciter is attached is not limited to an interior panel of a vehicle. The vibration limiting members according to the embodiment may be applied to any board member so long as it can emit sound by the propagation of vibration energy of the exciter. Further, even when using exciters of common specifications, it is possible to generate different sound quality if adjusting the predetermined distance of the vibration limiting members from the exciter or selectively arranging the direction of propagation of vibration.

What is claimed is:

1. An exciter comprising:

an outer yoke comprised of a side wall and a bottom;

a permanent magnet attached to said bottom;

an inner yoke placed on said permanent magnet and provided with a clearance from said side wall;

a coil wound around a cylindrically shaped bobbin and inserted into said clearance;

a coupler member fastening said bobbin, attached to a board member, and vibrating due to said coil being supplied with a drive signal so as to make said board member vibrate;

an elastic member elastically supporting said outer yoke and said coupler member;

a sealing member partitioning a clearance between said outer yoke and said coil from an outside space;

at least one passage provided at said bottom of the outer yoke at the outer circumference of said permanent magnet for communicating air between a closed space formed by said sealing member and the outside space;

wherein said coil is formed between said coupler member and the at least one passage; and wherein the at least one passage comprises a number of passages inversely related to the size of the closed space.

2. An exciter as set forth in claim 1, wherein one end of said sealing member is fastened at one end to said outer yoke or said elastic member, and other end of said sealing member is fastened to an outer surface of said bobbin.

3. An exciter as set forth in claim 1, wherein said sealing member is fastened at one end to said outer yoke and is fastened at the other end to said coupler member.

4. An exciter as set forth in claim 3, wherein said sealing member has a flexible body having a ring shape; and said body is formed integrally with one end face engaging with said outer yoke or said elastic member and another end face engaging with said coupler member.

5. An exciter as set forth in claim 1, wherein the at least one passage is provided at said bobbin.

6. An exciter as set forth in claim 1, wherein the at least one passage has an opening at said closed space side larger than an opening at said outside space side.

7. An exciter as set forth in claim 1, wherein said coil is supplied with said drive signal whereby said board forms a vibration board and a speaker emitting sound is formed.

8. An exciter as set forth in claim 1, wherein said board member is an interior panel of a vehicle.

9. An exciter as set forth in claim 1, wherein the at least one passage includes only one passage when the closed space is greater than a first size.

10. An exciter as set forth in claim 1, wherein the at least one passage includes a plurality of passages when the closed space is smaller than a first size.

11. An exciter as set forth in claim 1, further comprising:

a bracket member engaging with the coupler member and fastened to the board member.

12. An exciter as set forth in claim 11, wherein the at least one passage is provided at a first position different from a second position where the bracket member is attached to the board member.

13. An excited as set forth in claim 11, wherein the coupler member has a first engagement part opening to the closed space for engaging with a second engagement part of the bracket member; and wherein the second engagement part of the bracket member projects into the closed space and is engaged with the first engagement part of the coupler member.

* * * * *